US008770703B2

(12) United States Patent
Hatao

(10) Patent No.: US 8,770,703 B2
(45) Date of Patent: Jul. 8, 2014

(54) PRINTING DEVICE AND METHOD OF CONTROLLING A PRINTING DEVICE

(75) Inventor: Yosuke Hatao, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/451,754

(22) Filed: Apr. 20, 2012

(65) Prior Publication Data

US 2012/0268522 A1 Oct. 25, 2012

(30) Foreign Application Priority Data

Apr. 21, 2011 (JP) ..... 2011-094780

(51) Int. Cl.
*B41J 2/165* (2006.01)

(52) U.S. Cl.
USPC ..... 347/19

(58) Field of Classification Search
CPC ..... B41J 2/165
See application file for complete search history.

(56) References Cited

U.S. PATENT DOCUMENTS 5,625,384 A * 4/1997 Numata et al. ..... 347/23
2009/0066737 A1 3/2009 Sakurai
2012/0242731 A1 9/2012 Hatao

FOREIGN PATENT DOCUMENTS

JP 2009-066849 A 4/2009

* cited by examiner

*Primary Examiner* — Alejandro Valencia
(74) *Attorney, Agent, or Firm* — Nutter McClennen & Fish LLP

(57) ABSTRACT

A printing device has a print unit that ejects fluid from ejection nozzles and prints; an ejection test unit that checks if fluid is ejected from the ejection nozzles; a cleaning unit that performs a cleaning process in either a timed cleaning mode that performs a cleaning process at a predetermined interval, or an ejection test cleaning mode that performs a cleaning process based on a test result; a decision unit that determines whether to use the timed cleaning mode or the ejection test cleaning mode based on an operating condition of the print unit; and a mode changing unit that switches the mode between the timed cleaning mode and the ejection test cleaning mode according to the decision by the decision unit.

8 Claims, 10 Drawing Sheets

| NOZZLE LINE | COLOR OF EJECTED INK |
|---|---|
| A | C |
| B | M |
| C | Y |
| D | Y |
| E | M |
| F | C |

PRINTING DEVICE AND METHOD OF CONTROLLING A PRINTING DEVICE

BACKGROUND

1. Technical Field

The present invention relates to a printing device with an ejection head maintenance function, and to a method of controlling the printing device.

2. Related Art

Printing devices that have a recovery means for ejecting fluid in the ejection head to the outside to restore the fluid ejection performance of the ejection head, and control the recovery means according to how the user uses the printing device, are known from the literature. See, for example, Japanese Unexamined Patent Appl. Pub. JP-A-2009-066849. This printing device (printer) detects how frequently the power turns on/off, the print count, and the most frequent types of printing (monochrome or color printing) as indicators of how the user uses the printer, and based on the detected results changes the frequency of the recovery operation performed by the recovery means, and the type of fluid used in the recovery operation.

The recovery operation that restores the ejection performance of the ejection head by discharging fluid from the ejection head to the outside requires a specific amount of fluid, and a large amount of fluid may therefore be consumed by operations other than printing. Printers with an ejection head maintenance function ideally minimize fluid consumption by non-printing operations. However, because the printer cannot check confirm the actual ejection status of the ejection head before performing the recovery operation, the recovery operation that discharges fluid from the ejection head may be performed even though there is no problem with the ejection head and the recovery operation is unnecessary. In other words, fluid is consumed more than required by non-printing operations.

SUMMARY

A printing device and a method of controlling a printing device according to the invention can desirably maintain the ejection head while suppressing unnecessary consumption of fluid.

One aspect of the invention is a printing device including: a print unit that ejects fluid from a plurality of ejection nozzles and prints; an ejection test unit that inspects fluid ejection by the plural ejection nozzles; a cleaning unit that suctions fluid from and cleans the plural ejection nozzles, and cleans the nozzles in either a timed cleaning mode that performs the cleaning process at a specific interval, or an ejection test cleaning mode that performs the cleaning process based on the result of the ejection test; a decision unit that determines whether to use the timed cleaning mode or the ejection test cleaning mode based on an operating condition of the print unit; and a mode changing unit that switches the mode between the timed cleaning mode and the ejection test cleaning mode according to the decision by the decision unit.

Another aspect of the invention is a method of controlling a printing device having: a print unit that ejects fluid from a plurality of ejection nozzles and prints; an ejection test unit that inspects fluid ejection by the plural ejection nozzles; and a cleaning unit that suctions fluid from and cleans the plural ejection nozzles, and cleans the nozzles in either a timed cleaning mode that performs the cleaning process at a specific interval, or an ejection test cleaning mode that performs the cleaning process based on the result of the ejection test; the printing device executing a decision step that determines whether to use the timed cleaning mode or the ejection test cleaning mode based on the operating condition of the print unit, and a mode changing step that switches the mode between the timed cleaning mode and the ejection test cleaning mode according to the decision by the decision step.

Because the ejection test cleaning mode cleans the nozzles after checking the ejection state of the ejection nozzles, the invention suppresses the amount of fluid consumed by cleaning because fluid droplets are suctioned from the ejection nozzles when cleaning is needed. In addition, because the mode is changed between the ejection test cleaning mode and the timed cleaning mode according to the operating condition of the print unit, maintenance can be controlled appropriately to the operating condition of the print unit. More specifically, because the frequency of defective nozzles occurring differs according to the operating condition of the print unit, maintenance can be adjusted to the actual printing conditions to suppress fluid consumption by operations other than printing.

Preferably, the operating condition of the print unit indicates a print volume or operating time of the print unit.

When the operating condition is the volume printed by the print unit, and the print volume of the print unit over a specified period of time is low, cleaning is performed when fluid suction is necessary (ejection test cleaning mode) considering the low frequency of print unit use. When the print volume of the print unit in a specified period of time is high, cleaning is performed at a regular interval (timed cleaning mode) considering the high frequency of print unit use.

When the operating condition is the operating time of the print unit, and the operating time in a specified period of time is long, cleaning is performed at a regular interval (timed cleaning mode) considering the high likelihood of bubbles, which can cause fluid ejection problems, forming or growing inside the ejection head. When the operating time in a specified period of time is short, cleaning is performed when necessary (ejection test cleaning mode) considering the low likelihood of bubbles forming or growing in the ejection head.

Further preferably, the decision unit has an ambient temperature measuring unit that measures the ambient temperature of the print unit, and the mode changing unit changes the mode based on the temperature detected by the ambient temperature measuring unit.

When the ambient temperature is high in this aspect of the invention, cleaning is performed at a regular interval (timed cleaning mode) considering the high likelihood of bubbles, which can cause fluid ejection problems, forming or growing inside the ejection head. When the temperature is low, cleaning is performed when necessary (ejection test cleaning mode) considering the low likelihood of bubbles forming or growing in the ejection head. Note that the ambient temperature is preferably the temperature near the print unit inside the printing device.

Further preferably, the mode changing unit changes the specific interval between cleaning operations according to the operating conditions when the mode is changed to the timed cleaning mode.

By changing the interval between cleaning operations according to the operating condition of the print unit when in the timed cleaning mode, which does not test ejection by the nozzles before cleaning, excessive fluid consumption by unnecessary cleaning can be suppressed.

When in the ejection test cleaning mode, the cleaning unit further preferably cleans the print unit when more than a specific number of ejection nozzles are determined to not eject fluid in a specific number of ejection tests.

This aspect of the invention cleans when there are actually nozzles that are not operating correctly, and can therefore suppress fluid consumption and the time required for maintenance.

Further preferably, the print unit repeats the last print job after cleaning is completed in the ejection test cleaning mode.

This configuration is particularly convenient because print jobs in which there was a printing problem are automatically repeated.

In this case the ejection test unit preferably has an ejection drive unit that causes the print unit to eject charged fluid droplets from the ejection nozzles, an ejection target on which the ejected fluid droplets land, and a detection unit that detects change in current produced in the ejection target by the charged droplets landing thereon, and tests fluid ejection by the ejection nozzles based on change in the current.

Because the amount of fluid consumed in the ejection test is very small, the amount of fluid consumed for maintenance instead of printing can be suppressed.

Other objects and attainments together with a fuller understanding of the invention will become apparent and appreciated by referring to the following description and claims taken in conjunction with the accompanying drawings.

DESCRIPTION OF EMBODIMENTS

A printing device and a method of controlling a printing device according to a preferred embodiment of the invention is described below with reference to the accompanying figures. The printing device according to this embodiment of the invention repeatedly prints based on print data having unique information embedded in a specific format, such as in form printing, on roll paper used as the recording medium. This type of printing is referred to as "unit printing" below. This printing device has two modes including an ejection test cleaning mode that performs the ejection head cleaning process based on the results of an ejection test performed each time unit printing ends, and a timed cleaning mode that performs a cleaning process at regular times.

Note that herein the direction across the width of the roll paper used in the printing device is referred to as the primary scanning direction, and the length of the roll paper is the secondary scanning direction.

Figure 1:
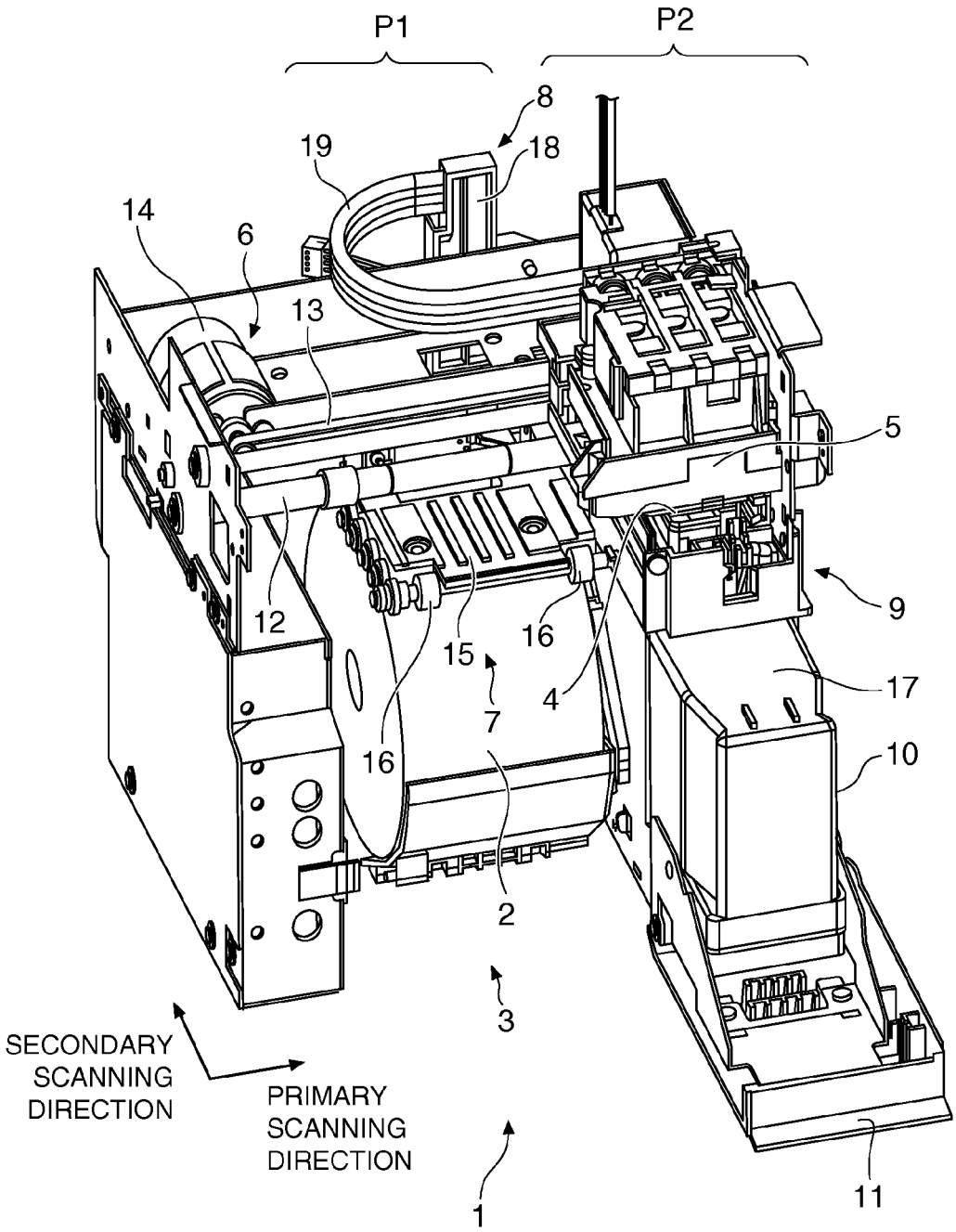
FIG. 1 is an oblique view of a printing device according to a preferred embodiment of the invention.

As shown in FIG. 1, the printing device 1 according to this embodiment of the invention includes: a roll paper compartment 3 that holds roll paper 2; a carriage 5 that carries an ejection head 4 that ejects plural different inks (fluid droplets) onto the roll paper 2; a carriage moving mechanism 6 that moves the carriage 5 in the primary scanning direction; a roll paper conveyance mechanism 7 that pulls the end of the roll paper 2 out in the secondary scanning direction; an ink supply mechanism 8 that supplies color ink to the ejection head 4; a maintenance mechanism 9 that performs maintenance of the ejection head 4; and a control unit 40 (FIG. 6) that centrally controls operation of these other parts. The printing device 1 is covered by a case (not shown). The printing device 1 also has a roll paper cover (not shown) for removing and loading roll paper 2 into the roll paper compartment 3, and a cartridge cover 11 for removing and installing the ink cartridges 10 of the ink supply mechanism 8.

The carriage moving mechanism 6 includes a guide shaft 12 that supports the carriage 5 movably in the primary scanning direction, an endless belt 13 disposed with the guide shaft 12, and a carriage motor 14 that causes the belt 13 to move circularly. The carriage moving mechanism 6 drives the carriage motor 14 to turn the belt 13 and move the carriage 5 in the primary scanning direction along the guide shaft 12.

The roll paper conveyance mechanism 7 includes a platen 15 disposed above the roll paper 2 opposite the carriage 5, and a paper feed roller 16 that conveys the end of the roll paper 2 passing above the platen 15 in the secondary scanning direction. The platen 15 pushes the roll paper 2 against the ejection head 4 mounted on the carriage 5, and the paper feed roller 16 discharges the printed roll paper 2 after printing.

The ink supply mechanism 8 includes an ink cartridge 10 loaded in the ink cartridge loading unit 17, and an ink channel 18 and ink supply tube 19 for supplying color ink to the ejection head 4 from ink packs for each color of ink stored in the ink cartridge 10. This embodiment of the invention uses ink packs and ink supply tubes 19 for three colors of ink, cyan (C), magenta (M), and yellow (Y) ink.

The maintenance mechanism 9 has a head cap 21 (FIG. 5) for sealing the nozzle surface 20 of the ejection head 4, an ink suction mechanism, and a wiper mechanism (both not shown) disposed opposite the carriage 5 at a position removed in the primary scanning direction from above the roll paper 2. One end of a tube from the ink suction mechanism is connected to the head cap 21, and the pressure inside the head cap 21 is reduced so that color ink is suctioned from the ejection nozzles N formed in the nozzle surface 20 by driving the pump motor of the ink suction mechanism. The wiper mechanism wipes contamination from the nozzle surface 20 using a rubber wiper.

The maintenance mechanism 9 applies a cleaning process to the ejection head 4 by performing the ink suction process of the ink suction mechanism and the wiping process of the wiper mechanism. Note that this cleaning process is performed to remove bubbles in the fluid droplet ejection head 4, which can cause ejection problems in numerous ejection nozzles, and the ink suction mechanism suctions ink with a specific suction force based on a control signal from the control unit 40.

The maintenance mechanism 9 performs a cleaning process after an ejection test of the ejection head 4 in the ejection test cleaning mode described below if an ejection problem is detected in the ejection test. The timed cleaning mode described below performs the cleaning process at a regular interval of 10 days or 15 days, for example. The maintenance mechanism 9 also performs a scheduled suction process that suctions ink with less suction power to prevent ejection problems in the timed cleaning mode when unit printing has been completed a specific number of times. These operations are described below.

Note that the position where the carriage 5 is opposite the roll paper 2 is the printing position P1, and the position where the carriage 5 is opposite the maintenance mechanism 9 is the maintenance position P2. The printing device 1 moves the carriage 5 to the printing position P1 for printing, and moves the carriage 5 to the maintenance position P2 for maintenance of the ejection head 4.

Figure 2:
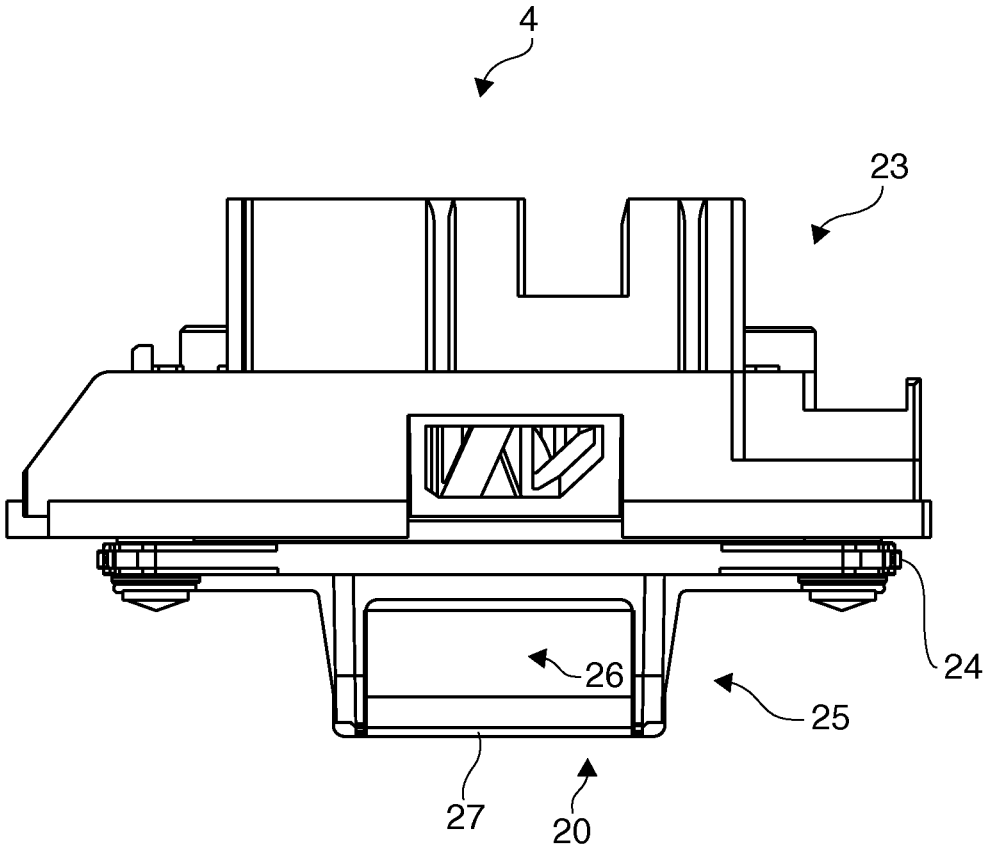
FIG. 2 is an external side view of the ejection head.
Figure 3A:
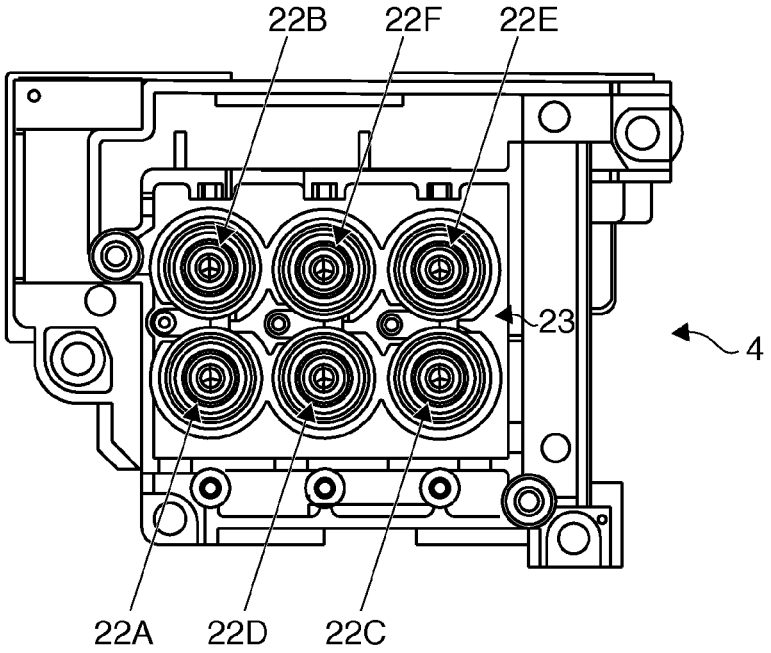
FIG. 3A is a plan view of the ejection head from the ink supply side.
Figure 3B:
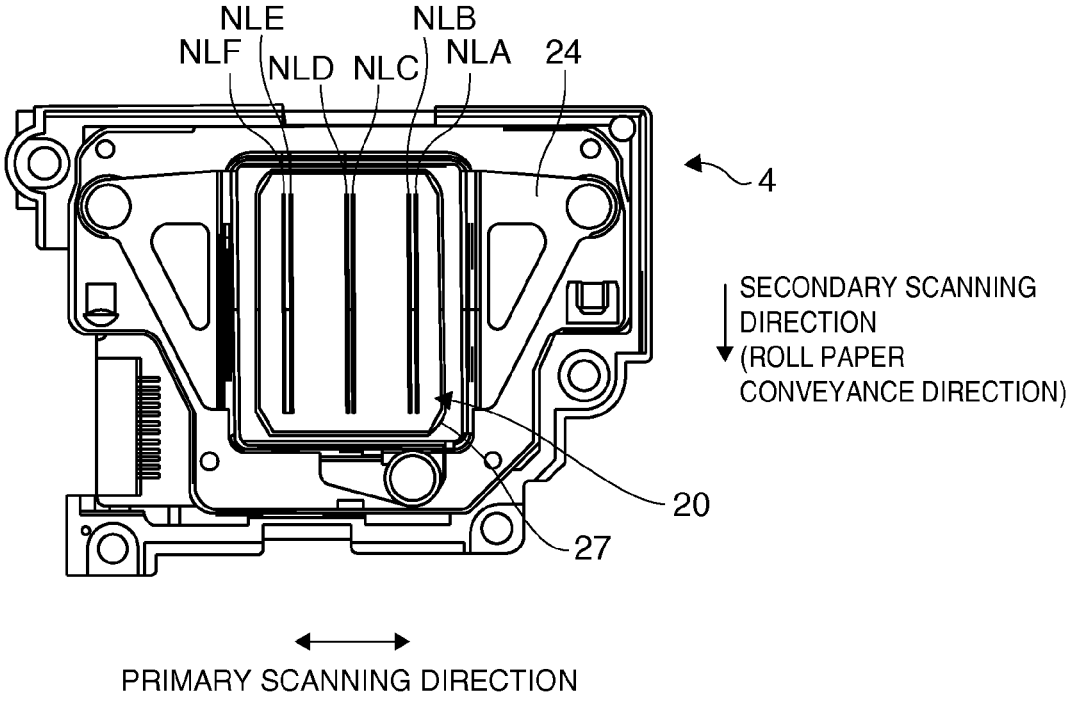
FIG. 3B is a plan view from the nozzle surface side.

As shown in FIG. 2 and FIG. 3, the ejection head 4 is a six-channel inkjet head, and has an ink inlet unit 23 with six connection needles 22; a head substrate 24 connected to the ink inlet unit 23; and a printhead 25 that is connected to the head substrate 24 and ejects ink. The ink inlet unit 23 has six connection needles 22A to 22F corresponding to the six nozzle lines NLA to NLF, and ink is supplied thereto from the ink supply mechanism 8. Note that the correlation between the connection needles 22 and the nozzle lines NL is as shown in FIG. 3.

The printhead 25 also has six pump units 26 rendered by piezoelectric devices, for example, and a nozzle plate 27 with a nozzle surface 20 in which a plurality of ejection nozzles N are formed. The printing device 1 ejects color ink from the ejection nozzles N by applying the drive signals output from a control device 40 to each pump unit 26.

Figures 4A, 4B:
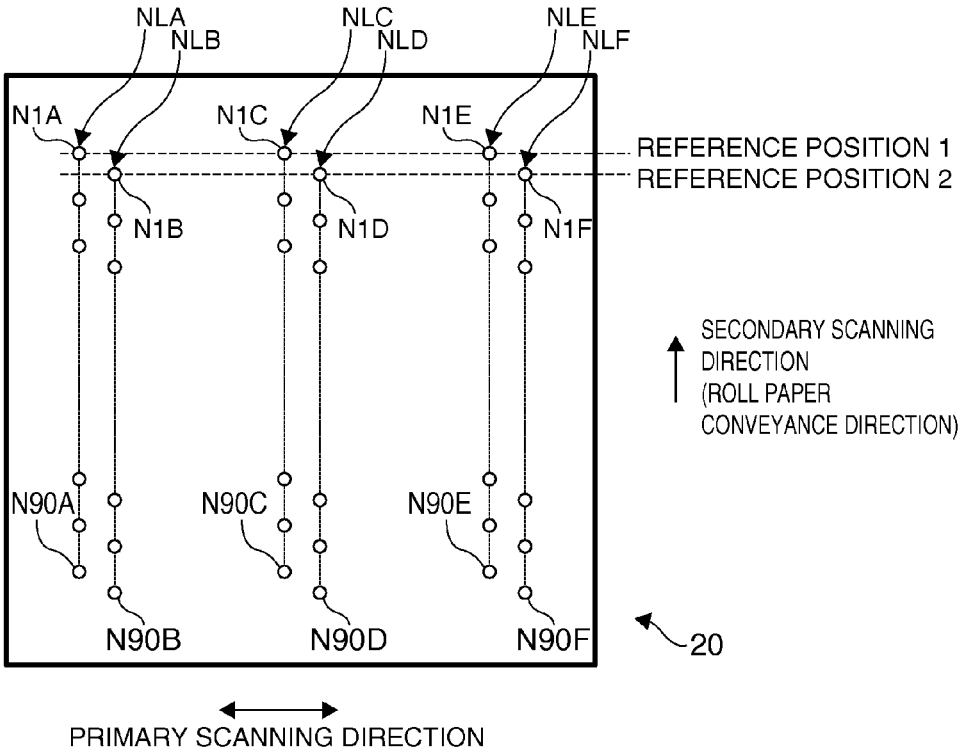
FIG. 4A schematically describes the arrangement of the ejection nozzles in the nozzle surface.
FIG. 4B is a table showing the type of ink ejected from each nozzle line.

FIG. 4 schematically describes the arrangement of the ejection nozzles N formed in the nozzle surface 20 of the nozzle plate 27. Note that this figure shows the nozzle plate 27 rotated 180 degrees from FIG. 3. As shown in the figure, the numerous ejection nozzles N formed in the nozzle surface 20 of the nozzle plate 27 are arranged in six nozzle lines NLA to NLF. Each nozzle line NL has 90 ejection nozzles N1 to N90 arrayed at a uniform pitch (nozzle pitch) in the secondary scanning direction. The nozzle lines NL are formed with three nozzle lines NLA, NLC, NLE disposed to reference position 1, and three nozzle lines NLB, NLD, NLF disposed to reference position 2, which is offset ½ nozzle pitch in the secondary scanning direction from reference position 1. The nozzle lines NL are thus formed mutually parallel and offset a half nozzle pitch.

FIG. 4(*b*) shows the color of ink ejected from each nozzle line NL. As shown in the figure, nozzle lines NLA and NLF eject cyan (C), nozzle lines NLB and NLE eject magenta (M), and nozzle lines NLC and NLD eject yellow (Y). More specifically, each color of ink is ejected from two nozzle lines NL at different reference positions.

The ejection head 4 prints the smallest printing width (smallest line width) in the secondary scanning direction by ejecting ink from the six ejection nozzles N composed of the same L ejection nozzle N in each nozzle line NL while moving in the primary scanning direction.

The smallest printing width is the thinnest line that the printing device 1 can print. For example, as shown in FIG. 4(*a*), the smallest printing width at the furthest downstream position of the print area is printed by the six ejection nozzles N1A, N1B, N1C, N1D, N1E, N1F. The ejection head 4 is thus configured to print the smallest printing width by means of plural ejection nozzles with a gap of a half nozzle pitch therebetween. The ejection head 4 prints in color by moving in the primary scanning direction while the ejection nozzles N with the same nozzle number in each nozzle line NL of the same reference position eject a different color of ink at the same position.

Figure 5:
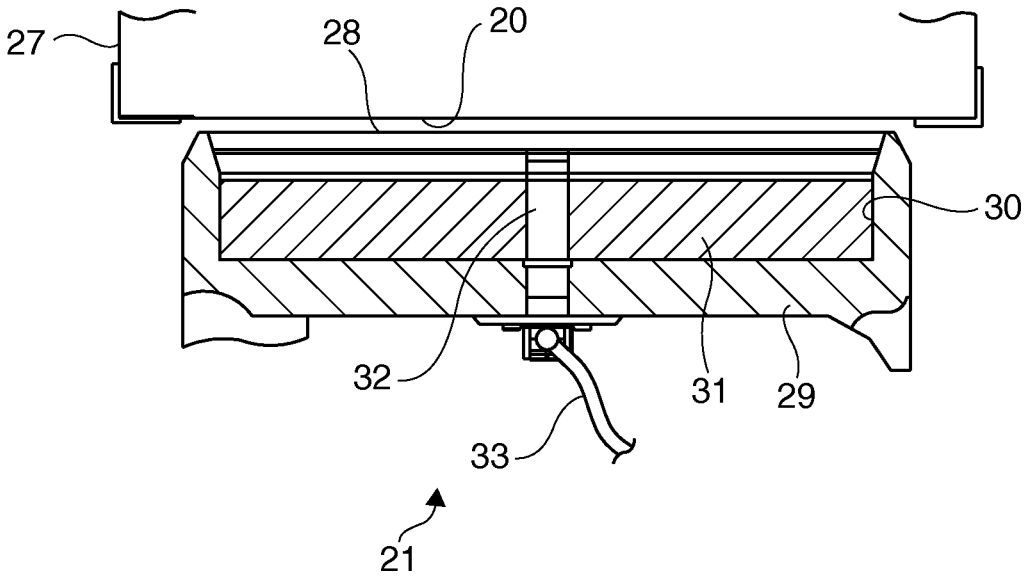
FIG. 5 is a section view of the head cap.

FIG. 5 is a section view of the head cap 21 of the maintenance mechanism 9. As shown in the figure, the head cap 21 has a lip 28 made of rubber or other elastic material that can fit tight to the nozzle surface 20; a box-like cap body 29 with an opening large enough to seal the nozzle surface 20 of the ejection head 4; a multilayer absorbent sponge 31 that absorbs waste ink contained in the recess 30 of the cap body 29; a metal shaft 32 that is electrically conductive with the absorbent sponge 31 and stands inside the recess 30 of the cap body 29; and a lead 33 connected to the bottom end of the metal shaft 32. The absorbent sponge 31 is disposed with a gap to the lip 28.

In the ejection test cleaning mode the maintenance mechanism 9 inspects the ink ejection state of ejection nozzles N of the ejection head 4 each time printing (unit printing) based on specific print data ends.

This ejection inspection first positions the head cap 21 opposite the nozzle surface 20 of the ejection head 4, and then selectively discharges charged ink from a plurality of ejection nozzles N by means of a drive signal from the control unit (ejection drive unit). Change in the current produced when the charged ink that is ejected lands on the absorbent sponge 31 (ejection target) is then detected through the metal shaft 32 and lead 33 (detection unit), and the control unit determines if fluid was ejected.

The ejection test is performed once for a plurality of ejection nozzles N, the result of the ejection test is "fail" (defective ejection) if the number of ejection nozzles N determined to have not ejected ink in the group of tested ejection nozzles N exceeds a specific number, and the result is "pass" (good fluid ejection) if the number of ejection nozzles N determined to have not ejected ink is within this specific number.

Figure 6:
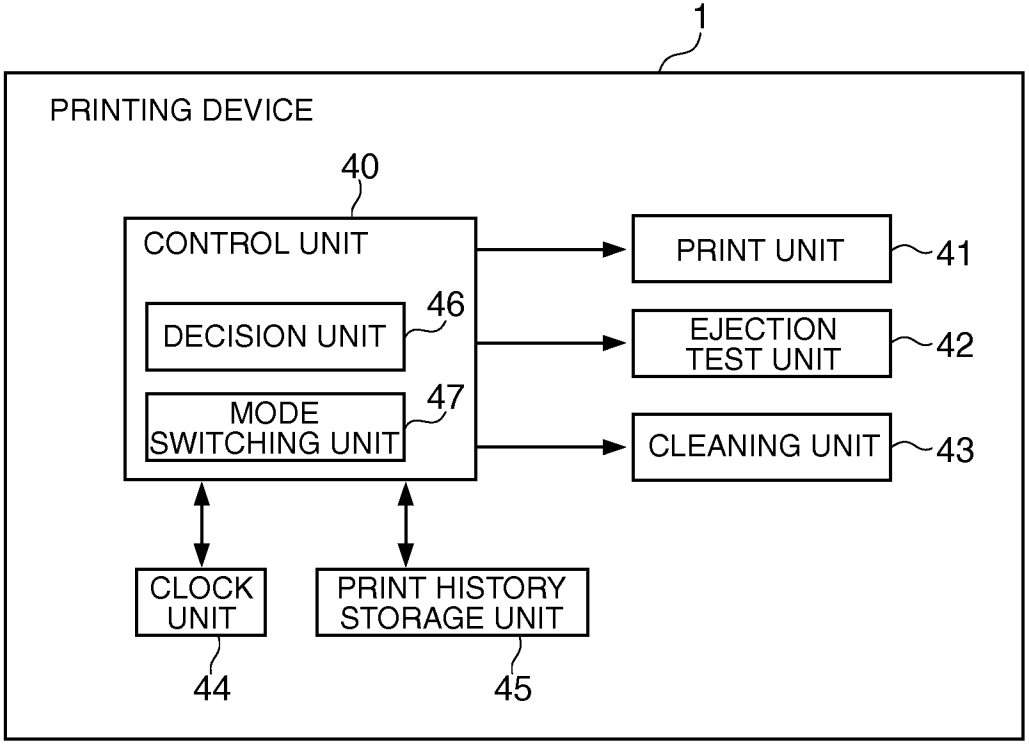
FIG. 6 is a block diagram showing the control configuration of the printing device.

The control configuration of the printing device 1 is described next with reference to FIG. 6. As shown in the figure, the printing device 1 has a print unit 41, ejection test unit 42, cleaning unit 43, clock unit 44, print history storage unit 45, and a control unit 40 that controls these other parts.

The print unit 41 includes the above ejection head 4, carriage 5, carriage moving mechanism 6, roll paper conveyance mechanism 7, and ink supply mechanism 8, and performs a printing process using the roll paper. The ejection test unit 42 includes mainly the head cap 21, and tests fluid ejection by the ejection head 4. The cleaning unit 43 includes the ink suction mechanism and the wiping mechanism, and applies a cleaning process to the ejection head 4.

The clock unit 44 is a real-time clock, for example, and keeps the date and time. The clock unit 44 is used in this embodiment to determine the timing for the cleaning process in the cleaning mode. The print history storage unit 45 nonvolatilely stores how many times printing based on the set print data in the most recent specified period of time has been performed (the number of unit printing operations).

The control unit 40 centrally controls the print unit 41, ejection test unit 42, and cleaning unit 43. The control unit 40 also has a decision unit 46 that determines the printing status (operating status) of the print unit 41, and a mode switching unit 47 that changes the printing and maintenance operation mode according to the result from the decision unit 46.

The decision unit 46 determines a daily print count n from the number of unit printing operations in the most recent specific period stored in the print history storage unit 45. The daily print count n in this embodiment is the average number of times unit printing was performed in the most recent specific period of time. Based on the calculated daily print count n, the decision unit 46 determines which operating mode to select. The mode switching unit 47 changes the mode to either the timed cleaning mode in which the ejection head 4 cleaning process is performed regularly, or the ejection test cleaning mode that performs the cleaning process based on the result of an ejection test performed after each unit printing operation, based on the result from the decision unit 46.

Figure 7:
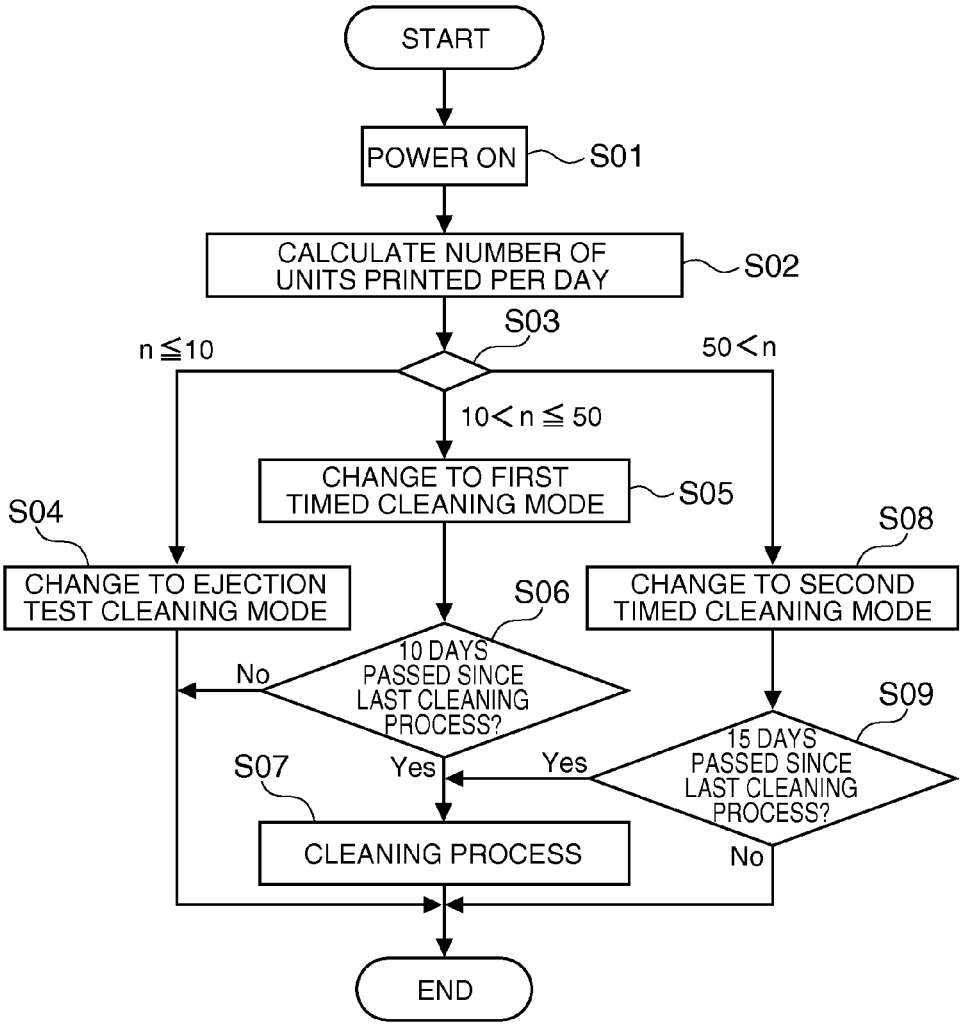
FIG. 7 is a flow chart of the mode switching process.

The mode switching process in this embodiment is described next with reference to the flow chart in FIG. 7. When the power turns on (S01), the printing device 1 determines the number of times unit printing was executed per day prior to when the power turned on (S02). If the print count n is n<=10, n<=10, or 50<n is determined (S03). If the print count n is n<=10 (S03: n<=10), the mode is changed to the ejection test cleaning mode (S04).

If the print count n is 10<n<=50 (S03: 10<n<=50), the mode is changed to the first timed cleaning mode, which performs a cleaning process every 10 days (S05).

If 10 days have passed since the last cleaning process (S06 returns Yes), the cleaning process is performed (S07). However, if the result is 50<n (S03: 50<n), the second timed cleaning mode, which performs the cleaning process every 15 days, is selected (S08). If 15 days have passed since the last cleaning process (S09 returns Yes), the cleaning process is performed (S07).

Figure 8:
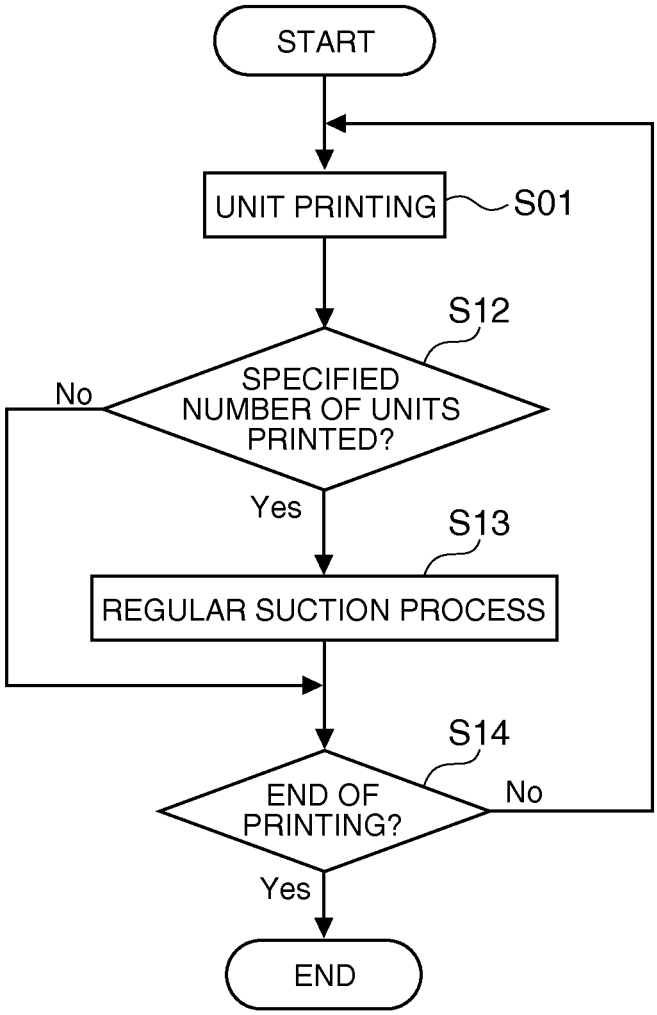
FIG. 8 is a flow chart of the printing process in the timed cleaning mode.

The printing process of the invention when the first cleaning mode or second cleaning mode is selected is described next referring to the flow chart in FIG. 8. The printing device 1 first performs the first unit printing operation (S11). If unit printing has been performed a specific number of times (S12 returns Yes), a regular suction process that differs from the cleaning process described above is performed (S13). When all printing ends (S14 returns Yes), the process ends. If all printing is not completed, steps S11 to S14 repeat. Because this embodiment performs a regular suction process whenever unit printing has been performed a specific number of times, the interval between cleaning processes in the second cleaning mode is set longer when the number of units printed n per day is relatively high (50<n) because ink is frequently suctioned by the regular suction process.

Figure 9:
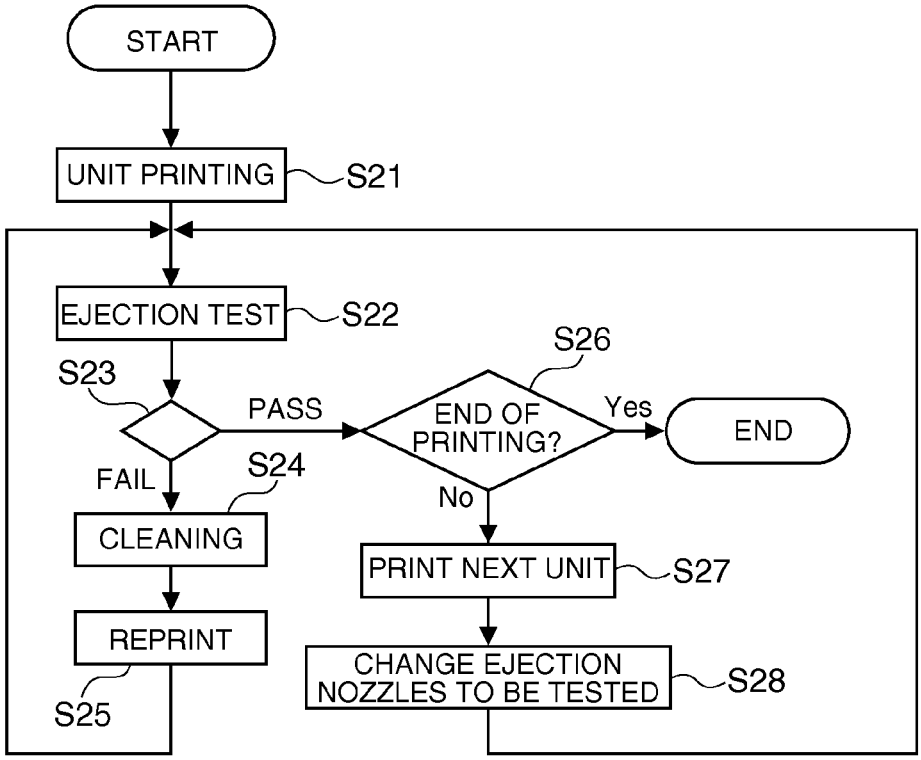
FIG. 9 is a flow chart of the printing process in the ejection test cleaning mode.

The ejection test cleaning mode is described next with reference to FIG. 9 and FIG. 10. The flow chart in FIG. 9 shows the printing process in the ejection test cleaning mode.

The printing device 1 first executes the first unit printing operation (S21), and then performs the ejection head 4 ejection test (S22). If the test is failed (S23 returns FAIL), the cleaning process is applied to the ejection head 4 (S24). The unit printing operation that was just performed is then repeated (S25).

However, if the test is passed (S23 returns PASS) and printing all print data is completed (S26 returns Yes), the process ends.

If printing all print data is not completed (S26 returns No), the unit printing operation is performed (S27). The group of nozzles inspected in the last ejection test is then changed (S28) and the next group of nozzles is tested (S22). Steps S22 to S28 repeat thereafter.

The ejection nozzles N that are inspected in the ejection test in the ejection test cleaning mode are described next with reference to FIG. 10.

To shorten the time required for the ejection test, the control unit 40 of the printing device 1 changes the ejection nozzles N that are tested in each ejection test by nozzle line NL. More specifically, the printing device 1 changes the nozzle line NL to be inspected in each ejection test.

Figure 10A:
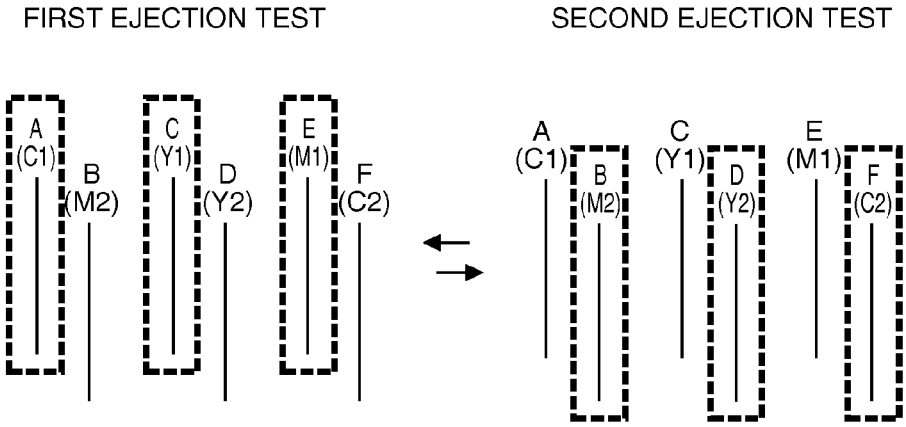
FIG. 10 shows a pattern for changing the nozzle line to be inspected.
Figure 10B:
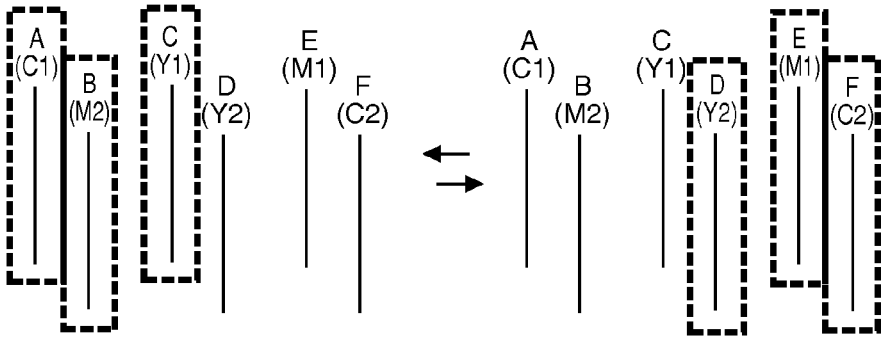
Figure 10C:
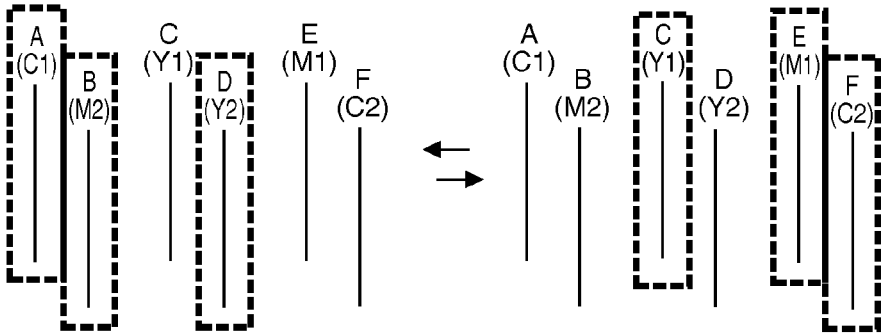

FIG. 10 shows three patterns in which the ejection nozzles N change in each ejection test.

In pattern 1 shown in FIG. 10(*a*), ejection by the three nozzle lines NLA, NLC, NLE referenced to reference position 1 is inspected in the first ejection test. In the second ejection test, ejection by the three nozzle lines NLB, NLD, NLF referenced to reference position 2 is tested. Ejection nozzles N that eject each color of ink at the same reference position are thus inspected in each ejection test with pattern 1. As a result, at least one ejection nozzle N discharging each color of ink that is part of the same group of ejection nozzles N used to form the smallest printing width can be inspected in every ejection test. Therefore, by performing the cleaning process when inspection fails and reprinting the immediately preceding print unit, dropout can be prevented without inspecting all ejection nozzles N in every ejection test.

With pattern 2 in FIG. 10(*b*), the nozzle lines NLA and NLC that are disposed to reference position 1 and eject cyan ink and yellow ink, and the nozzle line NLB disposed to reference position 2 that ejects magenta ink, are inspected in the first ejection test. The remaining nozzle lines NLD, NLE, NLF are then inspected in the second ejection test.

With pattern 3 in FIG. 10(*c*), the nozzle line NLA that is disposed to reference position 1 and ejects cyan ink, and the nozzle lines NLB and NLD disposed to reference position 2 that eject magenta ink and yellow ink, are inspected in the first ejection test. The remaining nozzle lines NLC, NLE, NLF are then inspected in the second ejection test.

Patterns 2 and 3 thus inspect the nozzle lines NL that eject cyan and magenta and are disposed at different reference positions in the first ejection inspection. As a result, dropout of black dots, which are primarily affected by ejection of cyan and magenta, can be prevented at the ejection positions on one of the reference positions.

The printing device 1 and method of controlling a printing device described above can apply an appropriate maintenance process suited to actual use of the ejection head 4 by controlling executing the cleaning process based on the number of times unit printing is performed each day. More specifically, the amount of fluid consumed in the cleaning process can be minimized when the number of unit printing operations per day is low (n<10) because whether to perform the cleaning process is determined after checking the ejection state of the ejection nozzles N in the ejection test based on the low frequency of ejection head 4 use. In addition, because the interval between cleaning processes is changed according to the number of unit printing operations per day (when 10<=n<50, or 50<=n), excessive fluid consumption by unnecessary cleaning can also be suppressed in the timed cleaning mode, which does not check the ejection state of the ejection nozzles N before performing the cleaning process.

The decision unit 46 in this embodiment of the invention calculates and evaluates the number of unit printing operations per day as an indicator of the print unit 41 operating status, but the operating time of the printing device 1 in a specific period of time (=total operating time) could be counted as an indicator of the print unit 41 operating status. The operating time could be measured per day or per week, for example. In these cases, the timed cleaning mode is selected when the printing device 1 operating time in the specific period is relatively long, and the ejection test cleaning mode is preferably selected when the printing device 1 operating time in the specific period is relatively short. The ambient temperature of the print unit 41 could also be measured as the print unit 41 operating status. In this case an ambient temperature measuring unit is preferably disposed to the decision unit, the timed cleaning mode is selected when the temperature of the print unit 41 is relatively high, and the ejection test cleaning mode is preferably selected when the temperature of the print unit 41 is relatively low. Note that the ambient humidity or air pressure around the print unit 41 could also be the operating condition of the print unit 41 that is evaluated by the decision unit 46.

Because the ejection test method in the ejection test cleaning mode in this embodiment changes the group of nozzles to be tested within the plurality of ejection nozzles N that form the smallest printing width every time a specific amount of printing is completed, the time required for each ejection test can be shortened and dropped dots can be prevented. The time required for the complete printing process can therefore be shortened. In addition, because the cleaning process is applied to the ejection head 4 only when ejection inspection fails, the number of times the cleaning process is performed can be reduced, and the amount of ink consumed without printing can be reduced.

While this embodiment performs the cleaning process when any one ejection test fails the inspected nozzles, a configuration that performs the cleaning process when the test is failed a specific number of times over plural ejection tests is also conceivable. As a result, performing the cleaning process unnecessarily when print defects have not occurred and delaying the printing process can be prevented. Reprinting unnecessarily can also be reduced.

The number of ejection heads 4 in the printing device 1, the number of ejection nozzles N, the number of nozzle lines NL, and the number of different inks can also be determined as desired. The print medium is also not limited to continuous paper as described above, and the invention can also be used with cut sheet media. In this case, the number of times unit printing was performed (number of units printed) could be the number of sheets printed.

The invention can also be applied to a printing system in which a personal computer having the control unit 40, print history storage unit 45, and clock unit 44 in the printing device 1 described above connected to at least the print unit 41, ejection test unit 42, and cleaning unit 43 of the printing device 1.

Elements of the printing device 1 described above can also be provided as a program. The program can also be supplied stored on a storage medium (not shown in the figure). Examples of such a storage medium include CD-ROM, flash ROM, memory cards (Compact Flash (R), smart media, and memory sticks, for example), CDs, magneto-optical media, DVDs, and floppy disks.

The configuration of and steps performed by the printing device 1 are also not limited to the foregoing embodiment, and the invention can obviously be varied in many ways. Such variations are not to be regarded as a departure from the spirit and scope of the invention, and all modifications that would be obvious to one skilled in the art are included within the scope of the following claims.

The entire disclosure of Japanese Patent Application No: 2011-94780, filed Apr. 21, 2011 is expressly incorporated by reference herein.

What is claimed is:

1. A printing device comprising:

a print unit that ejects fluid from ejection nozzles and prints;

an ejection test unit that inspects ejection by the ejection nozzles;

a cleaning unit that suctions fluid droplets from the ejection nozzles and performs a cleaning process;

a decision unit that determines whether to use either a timed cleaning mode that repeatedly performs the cleaning process at a predetermined interval or an ejection test cleaning mode that repeatedly performs the cleaning process based on the result of a test performed by the ejection test unit each time printing of specific print data ends, based on an operating condition of the print unit that indicates a print volume or operating time of the print unit; and a mode changing unit that switches between the timed cleaning mode and the ejection test cleaning mode according to the decision by the decision unit, wherein the decision unit selects the ejection test cleaning mode when the operating condition of the print unit is a first print volume and selects the timed cleaning mode when the operating condition of the print unit is a second print volume that is greater than the first print volume, and wherein the mode changing unit changes a specific interval at which the cleaning process is performed according to the operating condition of the print unit when the mode is changed to the timed cleaning mode, such that the cleaning process is performed at a first interval when the operating condition of the print unit is a third print volume that is greater than the second print volume and the cleaning process is performed at a second interval that is shorter than the first interval when the operating condition of the print unit is a print volume that is greater than the second print volume and less than the third print volume.

2. The printing device described in claim 1, wherein:

the decision unit selects the ejection test cleaning mode when the operating condition of the print unit is a first operating time, and selects the timed cleaning mode when the operating condition of the print unit is a second operating time that is longer than the first operating time.

3. The printing device described in claim 1, further comprising:

an ambient temperature measuring unit that measures ambient temperature of the print unit;

the decision unit determining the cleaning mode based on the ambient temperature detected by the ambient temperature measuring unit.

4. The printing device described in claim 1, wherein:

when the mode changing unit switches to the ejection test cleaning mode, the cleaning process is performed when the ejection nozzles does not eject in a predetermined number of ejection test.

5. The printing device described in claim 1, wherein:

when the cleaning process is performed in the ejection test cleaning mode and the cleaning process is completed, the print unit repeats the print job that was executed before the cleaning process was performed.

6. The printing device described in claim 1, wherein:

ejection test unit has an ejection drive unit that causes the print unit to eject charged fluid droplets from the ejection nozzles, an ejection target on which the ejected fluid droplets land, and a detection unit that detects change in current produced in the ejection target by the charged droplets landing thereon, and tests fluid ejection by the ejection nozzles based on change in the current.

7. A method of controlling a printing device, comprising steps of:

determining an operating condition of a print unit that indicates a print volume or operating time of the print unit;

selecting either a timed cleaning mode that repeatedly performs a cleaning process at a predetermined interval, or an ejection test cleaning mode that repeatedly performs a cleaning process based on a result of an ejection test of an ejection nozzle that determines an operating condition of the print unit and that is performed each time printing of specific print data ends, wherein the ejection test cleaning mode is selected when the operating condition of the print unit is a first print volume and the timed cleaning mode is selected when the operating condition of the print unit is a second print volume that is greater than the first print volume;

switching to a selected mode and executing the cleaning mode, and changing a specific interval at which the cleaning process is performed according to the operating condition of the print unit when the mode is switched to the timed cleaning mode, such that the cleaning process is performed at a first interval when the operating condition of the print unit is a third print volume that is greater than the second print volume and the cleaning process is performed at a second interval that is shorter than the first interval when the operating condition of the print unit is a print volume that is greater than the second print volume and less than the third print volume.

8. The method of controlling a printing device described in claim 7, further comprising steps of:

selecting the ejection test cleaning mode when the operating condition of the print unit is a first operating time; and selecting the timed cleaning mode when the operating condition of the print unit is a second operating time that is longer than the first operating time.

* * * * *